US006770824B1

(12) United States Patent
Faucher

(10) Patent No.: US 6,770,824 B1
(45) Date of Patent: Aug. 3, 2004

(54) BUCKLING KEY CAPS AND METHOD

(75) Inventor: Paul D. Faucher, Escondid, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/691,178

(22) Filed: Oct. 22, 2003

(51) Int. Cl.[7] ..... H01H 3/12

(52) U.S. Cl. ..... 200/5 A; 200/296; 200/512

(58) Field of Search ..... 200/5 A, 512–517, 200/296, 333, 341–345

(56) References Cited

U.S. PATENT DOCUMENTS

| | | | | | |
|---|---|---|---|---|---|
| 4,677,268 | A | * | 6/1987 | Nemeth et al. | 200/513 |
| 5,152,392 | A | * | 10/1992 | Iwasa | 200/517 |
| 5,172,114 | A | * | 12/1992 | Bedoya et al. | 341/27 |
| 5,212,356 | A | * | 5/1993 | English | 200/5 A |
| 5,772,010 | A | * | 6/1998 | Watanabe et al. | 200/406 |
| 6,664,491 | B2 | * | 12/2003 | Yanai et al. | 200/516 |
| 6,686,549 | B2 | * | 2/2004 | Douzono et al. | 200/341 |

* cited by examiner

*Primary Examiner*—Michael A. Friedhofer

(57) ABSTRACT

Various embodiment of control panel assembly and method are provided. In one representative embodiment a control panel assembly includes a key cap that is disposed between a bezel and an electrical circuit. The key cap buckles when it undergoes a compression between the bezel and the electrical circuit.

31 Claims, 6 Drawing Sheets

BUCKLING KEY CAPS AND METHOD

BACKGROUND

Image forming devices, such as copiers, facsimiles and printers, are being designed to have a broad range of performance features. For example multifunctional printers (MFP) combine functions of various machines such as copiers, facsimiles and printers, into a single piece of equipment can offer many possibilities. The image forming devices can be manufactured as one universal machine which can be later configured to meet specific end user requirements. More specifically, the image forming device may have a control panel assembly that can be customized for a particular end user by substituting various types of covers, also known as bezels. The bezels snap-fit onto other members of the control panel assembly and activate combinations of key caps, which are hidden from the user.

A problem with the current control panel assemblies is that the dimensional tolerances of the individual members can cause large dimensional interferences between the key caps and the bezels upon assembly. Therefore, the key caps which are not visible to the user exert a relatively large lifting force on the bezel that covers them, and in some cases, the force is great enough to displace the bezel or to unsnap the bezel.

BRIEF DESCRIPTION OF THE SEVERAL VIEWS OF THE DRAWINGS

The example embodiments of the present invention can be understood with reference to the following drawings. The components in the drawings are not necessarily to scale. Also, in the drawings, like reference numerals designate corresponding parts throughout the several views.

DETAILED DESCRIPTION

Figure 1:
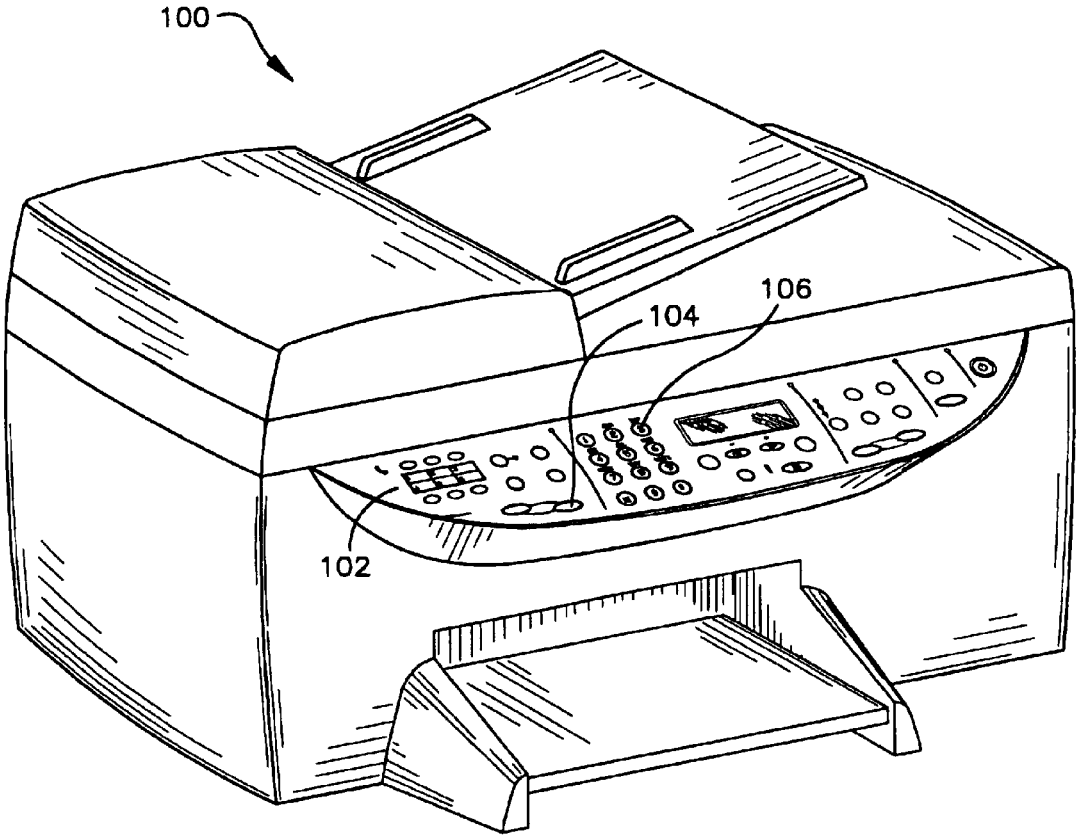
FIG. 1 is a perspective view of a multi-functional printer embodying an example of a control panel assembly having key caps according to an embodiment of the invention.

For convenience, example key caps are described within the environment of an image forming device that is a multi-functional printer (MFP), however, one skilled in the art can appreciate that the present invention could be used in other devices. Referring to FIG. 1, multi-functional printer 100 includes a control panel assembly 102 for operating a variety of functions. The control panel assembly includes various key caps 104, 106, visible to the user that allow the user to control various operational aspects such as, for example, facsimile dialing and control, copying control, printer control, and other operational parameters, etc.

Figure 2:
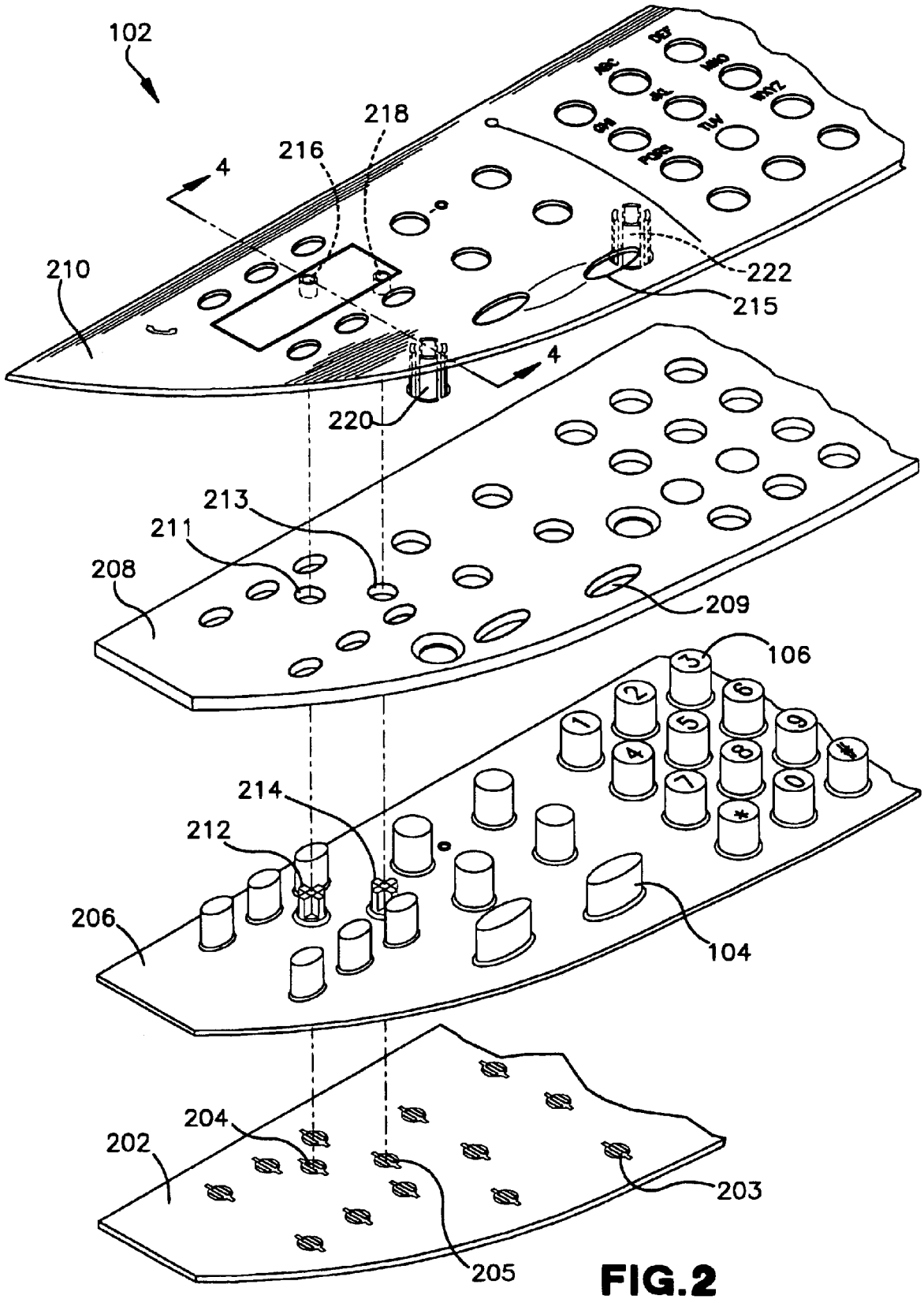
FIG. 2 is an exploded perspective view of the control panel assembly of FIG. 1 according to an embodiment of the invention.

FIG. 2 is an exploded perspective view of the control panel assembly 102 of FIG. 1 according to an embodiment of the invention. The control panel assembly 102 includes a printed circuit board 202, a keypad 206, a cover plate 208, and a bezel 210. The bezel 210 can be a plate, a panel, or one of many covers of a control panel assembly. The bezel 210 is typically the outermost member of the control panel assembly visible to the user, and can display written text indicating the features and functions of the machine. The printed circuit board 202 has areas of electrical circuitry 203, 204, 205, that can include integrated circuits such as logic gates and microprocessors, etc., and various circuit elements such as switches, resistors, capacitors, inductors, and other electronic circuit elements and electrical circuitry. Some areas of the electronic circuitry may be contacted by key caps 104, 212, 214, respectively, to control the operating functions of the multi-functional printer 100. The printed circuit board 202 may also provide structural support for the keypad 206. Cover plate 208 is located above keypad 206 and has a plurality of openings, for example, openings 209, 211, 213, aligned with the plurality of key caps, for example key caps 104, 212 and 214, respectively. Key caps, which are also commonly referred to as key-switches, are used to activate functions of an image forming device, for example the multi-functional printer 100, by advancing the key caps so that they contact areas of the electronic circuitry on printed circuit board 202. Bezel 210 also has a plurality of openings, for example opening 215, to expose select ones of the key caps for user activation. In this respect, bezel 210 has fewer openings than cover plate 208 in order to cover certain key caps, for example key caps 212 and 214, which are not accessible to the user. Protrusions 216 and 218 of bezel. 210 extend through openings 211 and 213 to depress or activate key caps 212 and 214, respectively, when control panel assembly 102 is assembled.

Image forming device 100 can be manufactured as a functionally universal machine which can be customized through an installation of a custom bezel 210. That is to say, for lesser versions of the image forming device 100 that include limited functionality, a custom bezel 210 may only include openings for applicable ones of the key caps to allow manipulation of corresponding ones of the electrical circuits on the printed circuit board 202, etc. However, it may be desirable that some key caps 212, 214 be depressed or otherwise actuated when the bezel 210 is in place, even though such key caps 212, 214 are not seen by a user. To accomplish this, protrusions 216, 218 on the underside surface of the bezel 210 push down the key caps 212, 214, respectively, so that they exert pressure and remain in contact with specific electrical circuitry such as electrical contact areas 204, 205 of circuit board 202.

In some embodiments, for example, a select number of protrusions 216 and 218 may be included on bezel 210 that contact select ones of the key caps 212, 214. The keypad 206 may also have additional key caps (not shown) and bezel 210 may have additional protrusions (not shown) for depressing key caps not visible to the user. Also, in some cases, a protrusion may not be included in the bezel 210 such that, for example, a predefined key cap 212, 214 is not compressed when the bezel 210 is in place. Thus, customization of control panel assembly 102 can be achieved by substitution of different bezels 210 having a different number or protrusions or a different arrangement of protrusions, or both, on bezel 210 to depress key caps hidden from the user. The key caps 212, 214 are "hidden" in that they are not visible by a user as they lie underneath the bezel 210 when it is in place. The attachment of different bezels 210 results in different combinations of contact areas 204, 205 of circuit board 202 being contacted. Therefore, alternative bezel 210 configurations provide access to varying combinations of features.

Figure 3:
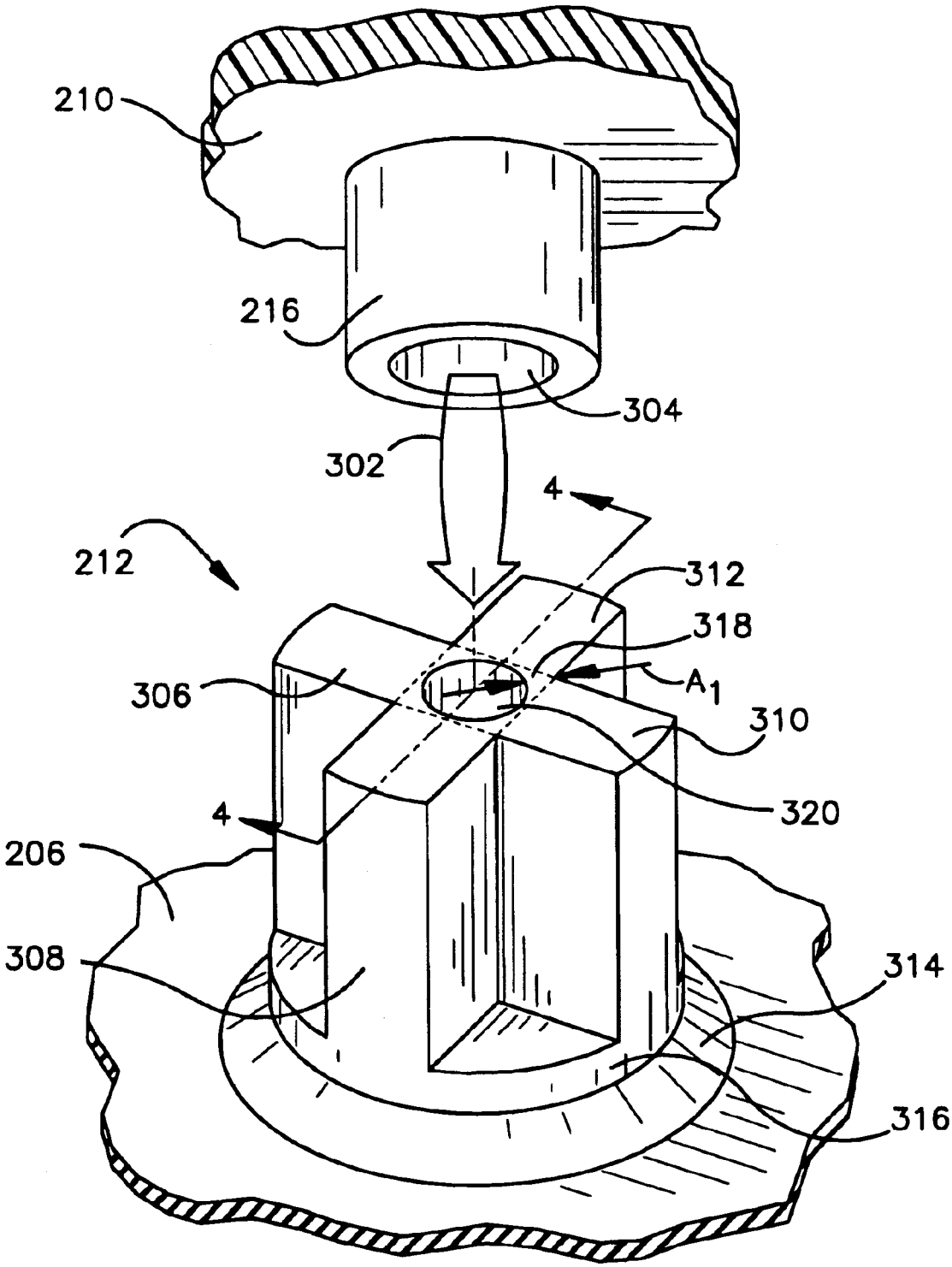
FIG. 3 is a perspective view of an example embodiment of a key cap in the control panel assembly of FIG. 2 according to an embodiment of the invention.

FIG. 3 is a perspective view of key cap 212 prior to contact by protrusion 216 of bezel 210 which moves along an axis in direction 302. Protrusion 216 can be an annular body having opening 304, as shown, and can also be one of several shapes including, for example, a solid cylindrical body. A deflection associated with the attachment of bezel 210 in assembly of the operating panel 102 (FIG. 2) causes key cap 212 to buckle due to the compressive force exerted by protrusion 216. The term "buckle" means that upon application of a force that is greater than a critical force, the key cap 212 bends, bulges, or kinks, and the key cap 212 experiences a negative, i.e., decreasing, rate of change in the slope of a force versus displacement curve. The critical force is the force that is necessary to place the key cap 212 in the condition of unstable equilibrium. The critical force depends upon the geometry and the modulus of elasticity of the key cap 212, and can be determined by those of ordinary skill in the art. Thus in a control panel assembly 102, the key cap 212 buckles when key cap 212 is subject to a compressive force by the bezel 210 and circuit board 202 (FIG. 2) at contact area 204 (FIG. 2).

In some embodiments of the present invention, key cap 212 can include at least one column, for example column 306, which can buckle under compressive force. In such case, the column 306 has a slenderness ratio, (l/k), according to the following equation:

$$\frac{l}{k} \geq \sqrt{\frac{C\pi^2 E}{P_{cr}/A}}$$

wherein l is the length of the column, k is the radius of gyration, $P_{cr}/A$ is the critical unit load per unit cross sectional area E is the modulus of elasticity and C is the end-condition constant that theoretically ranges from about ¼ to about 4. The above relationship can pertain to columns that buckle with both central loading and eccentric loading, and columns having rounded, pivoted, fixed or free ends, and combinations thereof. In some embodiments, the column, for example column 306, has one end fixed and one end free and C, the end-condition constant, ranges from about ¼ to about 2.

The theoretical slenderness ratio is well known to those of ordinary skill in the art and the relationship of the variables in the above equation are found in *Mechanical Engineering Design*, by Joseph Edward Shigley and Charles R. Mischke, fifth edition, 1989, pages 120–128, which is hereby incorporated by reference herein.

In one embodiment, key caps 212, 214 have four columns 306, 308, 310, and 312 arranged concentrically about a central axis in the direction 302 of compression. It is not necessary that the columns 306, 308, 310, and 312 are concentric, and other arrangements are possible. An annular rib 314 connects the body 316 of key cap 212 to keypad 206. A key cap, such as key cap 212, which has more than one column provides a substantially uniformly distributed load for making contact with an area of electrical circuitry 204 (FIG. 2) on circuit board 202 (FIG. 2). Although the slenderness ratio of columns 306, 308, 310, and 312 expressed by the equation above pertains to independent columns 306, 308, 310, and 312 which are unattached, columns 306, 308, 310, and 312 can also be attached at adjacent corners as shown by key cap 212 of FIG. 3.

The columns 306, 308, 310, and 312 of key cap 212 are connected by a connecting web 318 that surrounds a central opening 320, and the portion of connecting web 318 has a cross-sectional area $A_1$ between key caps 310 and 312. The effect of the connecting web 318 on the force required for buckling may be discounted or ignored if the material composition of key cap 212 has a very low modulus of elasticity, for example less than about 500 psi, and the cross sectional area of the portion of the connecting web 318 between two columns, for example columns 310 and 312, is about 10% or less of the cross-sectional area of at least one of column 310, 312. The cross-sectional area of the portion of connecting web 318 can depend in part on the modulus of elasticity of the material composition used in the key cap 312, and in some embodiments the cross sectional area of the portion of the connecting web 318 between two columns, for example columns 310 and 312, is about 5% or less of the cross-sectional area of at least one of column 310, 312. In such a case where both conditions are met and there is very little coupling between each column, then the collapse of one of the columns 310, 312 will facilitate the collapse of the others by creating instability.

Regardless of the number and arrangement of columns 306, 308, 310, and. 312, key cap 212 undergoes buckling by a compressive force if the key cap 212 experiences a negative, i.e. decreasing, rate of change in the slope of a force versus displacement curve. It is possible that under some circumstances, for example as a result of part to part variation in manufacturing, that only one or two columns will buckle, for example column 306, or columns 306 and 308. Nevertheless, the keycap 212 buckles when at least one of columns 306, 308, 310, and 312 buckles. In some situations none of the columns 306, 308, 310, and 312 buckles because a critical force has not been attained that places the key cap 212 in the condition of unstable equilibrium.

The key cap 212 can be made from at least one of many flexible thermoplastic and thermoset material compositions, including but are not limited to, silicone rubber, natural rubber, polyolefin, copolyester, or any other elastomers and highly elastic materials, for example, and combinations thereof. The modulus of elasticity of the material composition of key cap 212 is less than about 500 psi and in some embodiments, the modulus of elasticity can range from about 50 psi to about 500 psi. While the hardness may vary, in an example embodiment, the hardness of the material composition of key cap 212 is less than about 90 Shore A, and in some embodiments can range from about 20 Shore A to about 90 Shore A. Also, the keypad 206 and key cap 212 can both be formed of the same material composition, for example via an injection molding process, and in alternative embodiments, the material compositions can be distinct from each other.

Figure 4:
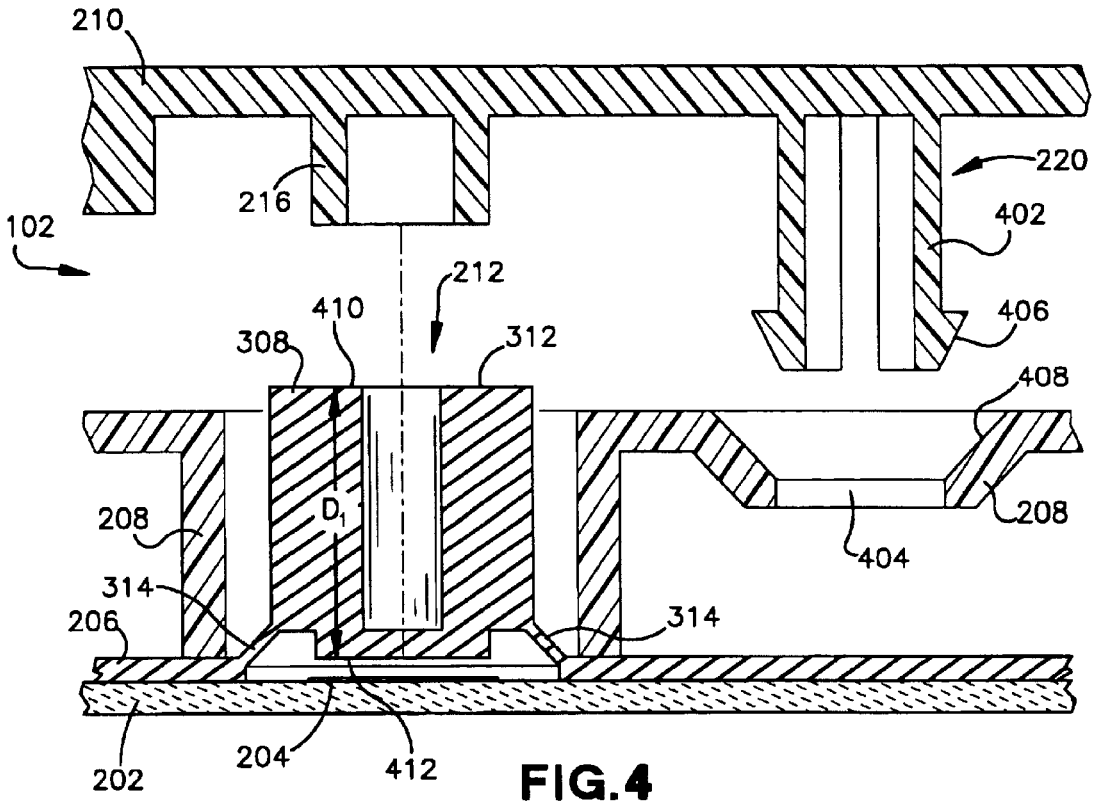
FIG. 4 is a front elevation cross-sectional view of the control panel assembly of FIGS. 2 and 3 partially assembled according to an embodiment of the invention.

FIG. 4 is a front elevation view of a control panel assembly 102 as bezel 210 is being attached. FIG. 4 illustrates a cross-sectional view of unattached bezel 210 taken along line 4—4 of FIG. 2, and a cross-sectional view of key cap 212 and keypad 206 taken along line 4—4 of FIG. 3. Fastener 220 of bezel 210 has barbed tabs 402 that can be inserted into opening 404 of cover plate 208 during attachment of the bezel 210. The diameter of the end portion 406 of fastener 220 is larger than the diameter of opening 404, however, when the bezel 210 is moved toward cover plate 208 the fastener 220 comes into contact with the chamfered walls 408 surrounding the opening 404 of cover plate 208, thereby causing the barbed ends on the tabs of the fastener 220 to bend inwardly allowing insertion of the fastener through the opening 404. Annular rib 314 suspends the key cap 212 above the area of electrical circuitry 204 of circuit board 202 prior to the attachment of bezel 210. The distance $D_1$ is the overall height the key cap 212 measured from the top 410 to the base 412 of key cap 212.

Figure 5:
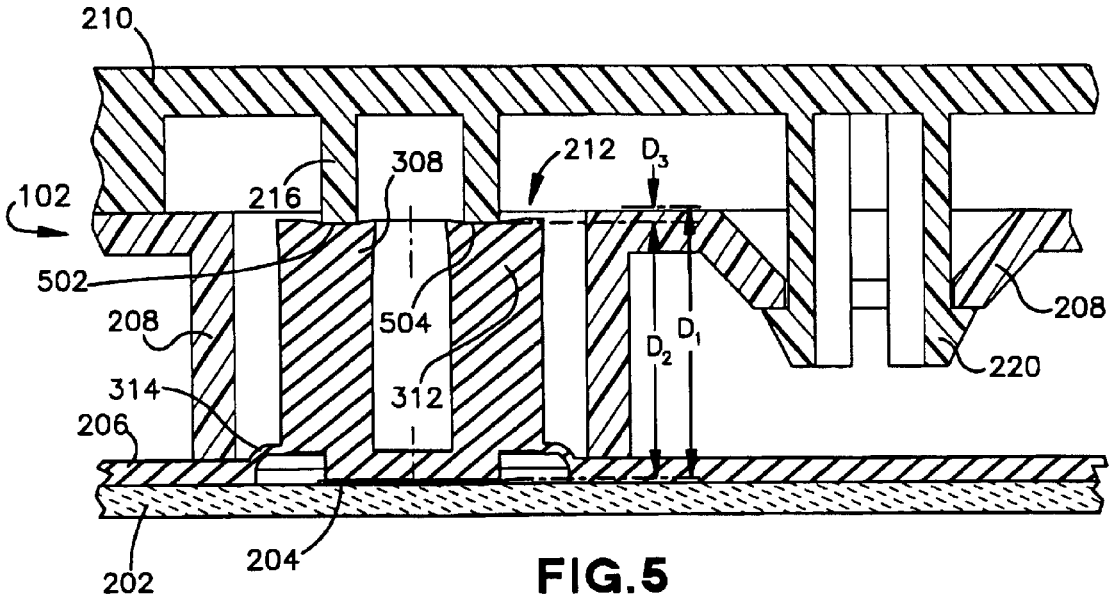
FIG. 5 is a front elevation cross-sectional view of a control panel assembly of FIG. 4 once assembled according to an embodiment of the invention.

In FIG. 5 the fastener 220 of bezel 210 is connected to cover plate 208 and protrusion 216 of the bezel 210 is in contact with key cap 212. The distance $D_2$ is the contact distance, or the distance between the area of electrical circuitry 204 and the bottom 502 of protrusion 216 when the bezel 210 is connected to the cover plate 208. The attachment of the bezel 210 to the cover plate 208 causes deformation and compression of the key cap 212 due to a dimensional interference between protrusion 216 and key cap 212. The dimensional interference, distance $D_3$ is termed herein as the minimum over-travel and is a distance greater than the difference between $D_1$ and $D_2$. Key cap 212 can be sized such that the minimum over-travel, or distance $D_3$ is greater than zero to ensure contact between the key cap 212 and the area of electronic circuitry 204 of printed circuit board 202 when the operator panel assembly 102 is assembled. The overall height of key cap 212, distance $D_1$ and the minimum over-travel $D_3$ are determined by taking into account the combined tolerances, commonly known as the stack tolerance, of the members 202, 206, 208, 210, 212 and 216 of operator panel assembly 102. The over-travel causes compression of annular rib 314 and key cap 212.

Figure 6:
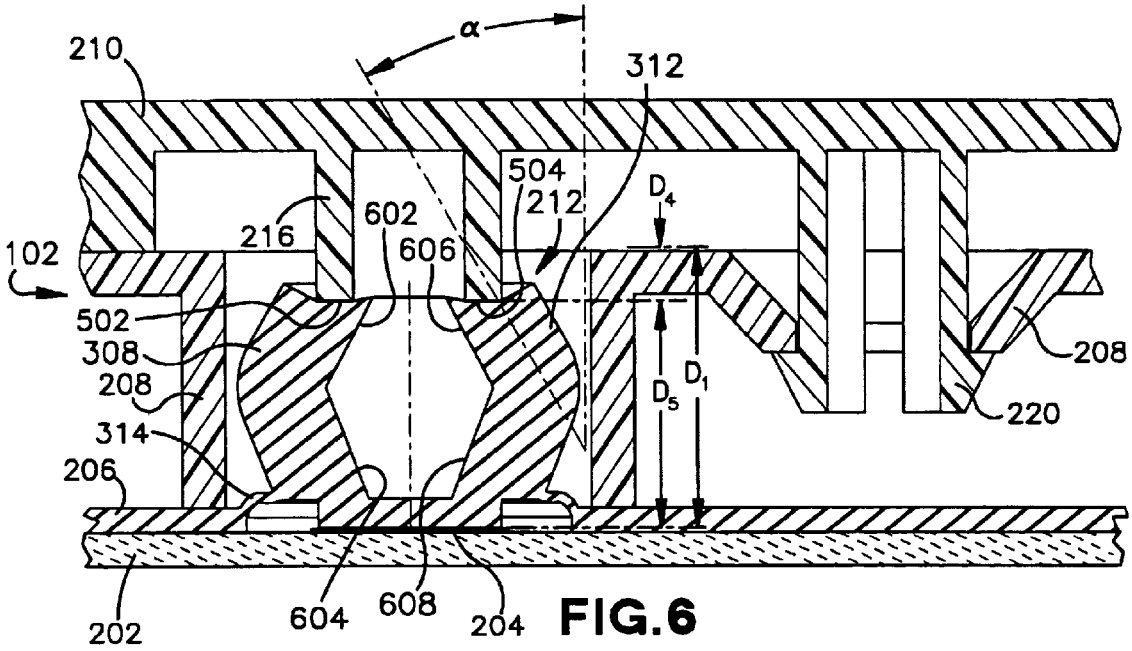
FIG. 6 is a front elevation cross-sectional view of a control panel assembly of FIG. 4 that includes a buckled key cap according to an embodiment of the invention.
Figure 8:
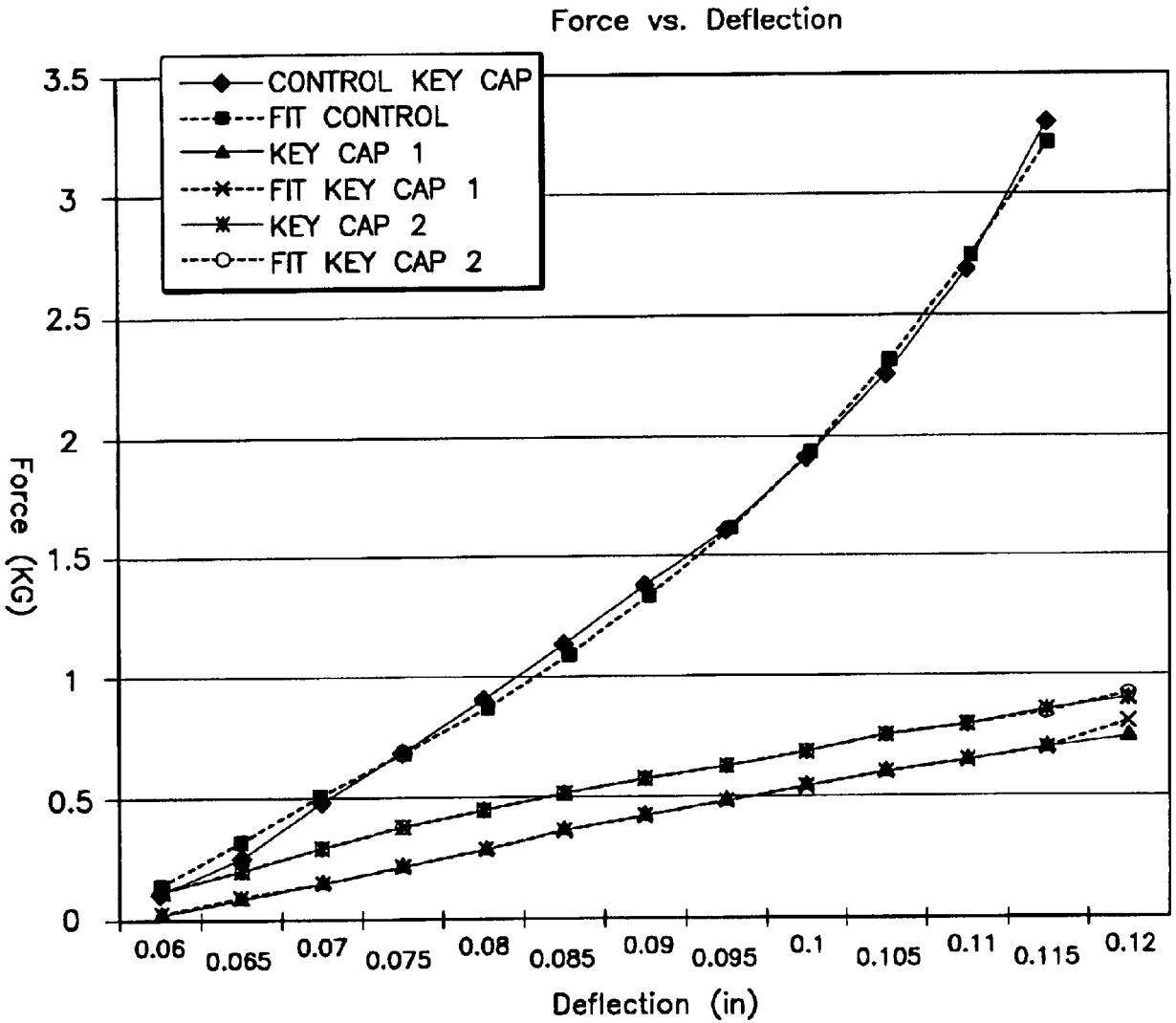
FIG. 8 is a graph showing the force and the corresponding deflection acting on key caps according to an embodiment of the invention.

FIG. 6 is a front elevation cross-sectional view of a control panel assembly 102 showing one of several potential modes for a buckled key cap 212 in accordance with an embodiment of the invention. Dimensional interference $D_4$ is greater than the minimum over-travel $D_3$ (FIG. 5) and $D_4$ is equal to the difference between $D_1$, the overall height the key cap 212, and $D_5$, the distance between the area of electrical circuitry 204 and the bottom 502 of protrusion 216 when the bezel 210 is connected to the cover plate 208. Columns 308 and 312 are buckled due to the compressive forces at the interfaces 502 and 504 between protrusion 216 and columns 308 and 312. The buckling creates an angle of deflection, $\alpha$, in the longitudinal axis of column 312. The angle of deflection, $\alpha$, can be as high as about 160 degrees. An angle of deflection greater than zero will cause instability and buckling of key cap 212. Whereas the force created by the same deflection of conventional key caps can cause the bezel 210 to lift away from members 202, 206 and 208 of operating panel assembly 102, the buckling of key cap 212 in an embodiment of the present invention substantially reduces the force exerted by key cap 212 on the bezel 210. A plot of data comparing the force as a function of displacement of key cap 212 is compared to that of a conventional key cap in FIG. 8 as will be described below.

Figure 7:
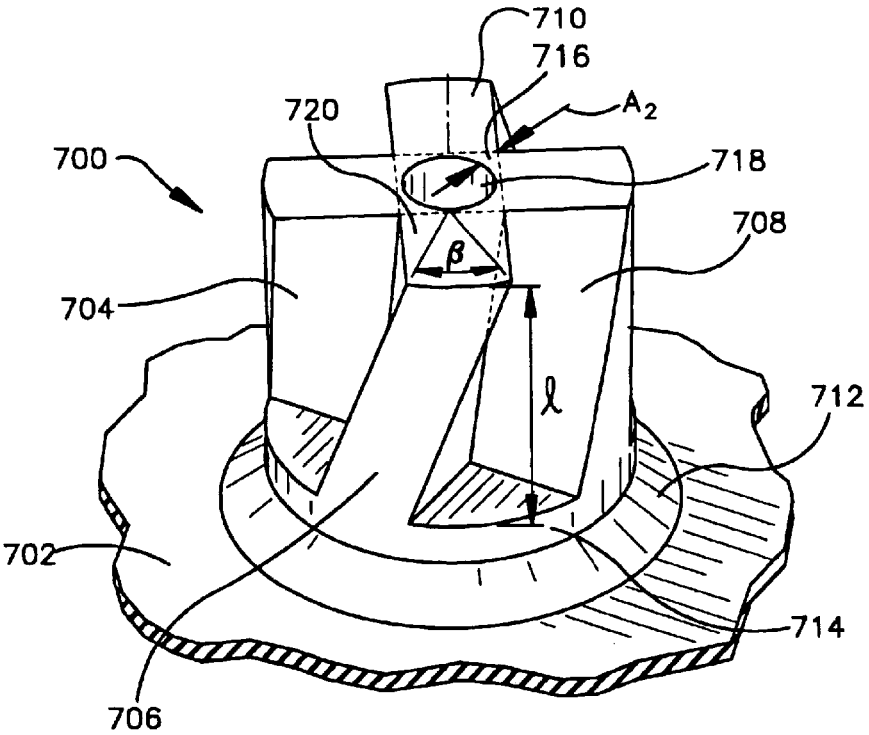
FIG. 7 is a perspective view of an example embodiment of a key cap of a control panel assembly of FIG. 1 according to an embodiment of the invention.

FIG. 7 shows a perspective view of a key cap 700 of that can be used in control panel assembly 102 of FIG. 1 in accordance with another example embodiment of the invention. Key cap 700 which is mentioned on keypad 702 can include at least one helical column, for example column 704, which can buckle under compressive force. In such case, the helical column 704 has a slenderness ratio, (l/k), according to the mathematical relationship described above with respect to column 306 (FIG. 3) of key cap 212 (FIG. 3).

Key cap 700 has four helical columns 704, 706, 708 and 710 arranged concentrically about an axis, however, it is not necessary that the columns are arranged concentrically and other arrangements are possible. The multiple columns of key cap 700, provide a substantially uniformly distributed load for making contact with, for example, an area of electrical circuitry 204 (FIG. 2) on circuit board 202 (FIG. 2). Although the four helical columns 704, 706, 708 and 710 are shown physically connected together, in an alternative design, they may also be unattached and independent from one another. The columns 704, 706, 708 and 710 of key cap 700 are connected by connecting web 716 that surrounds a central opening 718 of key cap 700. The portion of connecting web 716 between key caps 708 and 710 has a cross-sectional area, $A_2$. Regardless of the number and arrangement of columns 704, 706, 708 and 710, key cap 700 undergoes buckling by a compressive force if the key cap 700 experiences a negative, i.e. decreasing, rate of change in the slope of a force versus displacement curve.

It has been found that less force is exerted on the bezel 210 by the key cap 700 having a helical design than the force exerted on bezel 210 by key cap 212 having a straight column design (FIG. 3). According to various embodiments of the present invention, the pitch of the helix may range from a minimum pitch greater than zero to a maximum pitch at which the columns of key cap 700 exhibit spring-like behavior. The precise pitch chosen is design specific, and can depend on the slenderness ratio, the material composition, etc., and can be determined by one of ordinary skill in the art.

Referring to FIG. 7 in one embodiment the pitch can be at least as great as ½ the rotational size, $\beta$, of the face 720 of column 706 along the length, l, of column 706, for example. That is to say, the face 720 on the end of column 706 is rotated through ½ the angle inscribed, $\beta$, by face 720. For example if four columns 704, 706, 708, 710 are positioned radially about a longitudinal axis with each column face occupying 10 degrees of rotation and a column length, l, of each column is 5 mm, the pitch would be abut one (1) degree per each millimeter, or 360 degrees revolution per 360 millimeters. This equates to 5 degrees of total rotation, along the length, l, of keycap 700. Again, there is a maximum pitch at which the columns 704, 706, 708, 710 of key cap 700 would exhibit spring-like behavior and can be determined by a person of ordinary skill in the art.

Key cap 700 can be made from at least one of many flexible thermoplastic and thermoset material compositions, having a modulus of elasticity of about 500 psi or less, and a hardness of about 90 Shore A or softer, as was described above with respect to key cap 212 (FIG. 3).

Working Examples

A comparison test of the amount of force required for deflection of various key caps was conducted. Force versus deflection data were obtained for two key caps, Key Cap 1 and Key Cap 2, having a cross key cap design with four columns, for example key cap. 212 (FIGS. 2 and 3), and a solid cylindrical key cap (control). The four columns of Key Cap 1 were connected by a connecting web as shown in FIG. 3 above, and the four columns of Key Cap 2 were independent of one another and not connected. A graph showing the force acting on the key caps and the corresponding deflection of the key caps is illustrated in FIG. 7.

Data were measured according to the following experimental method: A key cap was placed on a vertical micrometer table having height adjustments within 0.001 inches. A fixture was placed on the key cap and attached to a force transducer, model SSM-10 available from Mark-10 Corporation of Hicksville, N.Y. As the micrometer table moved in an upward direction the amount of force exerted by the key caps was recorded using a transducer, model BGI available from Mark-10 Corporation. This procedure was repeated for each sample key cap.

Details of the compression molded key cap test specimens were as follows:

Control Key Cap: The control key cap was a solid cylindrical cap made of silicone rubber grade having a hardness of 60 Shore A +/−5. The control key cap had a height of approximately 0.14 inches and a diameter of approximately 0.195 inches.

Key Cap 1: The key cap was made of silicone rubber, grade having a hardness of 60 Shore A +/−5. The key cap 1 had an overall height of 0.15 inches and the height, width, and depth of the columns were approximately 0.125 inches, 0.65 inches, and 0.65 inches respectively. The Key Cap 1 was molded such that the each column was attached to the adjacent columns by a connecting web.

Key Cap 2: cap was made of silicone rubber, grade having a hardness of 60 Shore A +/−5. The key cap 2 had an overall height of 0.48 inches and the height, width, and depth of the columns were approximately 0.30 inches, 0.135 inches, and 0.10 inches, respectively. The Key Cap 2 was molded such that the each column was independent and unattached to the other columns.

The force/deflection data for a deflection range of 0.055 inches to 0.12 inches were fit to computer-generated third order polynomial curves, that were fit to about 94–95% accuracy. The force/deflection data for a deflection range of 0.055 inches to 0.12 inches were fit to computer-generated third order polynomial curves, that were fit to about 94–95% accuracy. The second derivative was taken of each computer-generated third order polynomial equation to indicate the rate of change of the slope of the curves. The second derivative of the curve of the Control Key Cap data was positive, indicating a positive, nonlinear rate of change in the force applied, whereas the second derivative of the curves of the Key Cap 1 data and the Key Cap 2 data was negative indicating a nonlinear, negative rate of change in the force applied due to buckling. The plots of FIG. 7 also indicate a much lower force is required to deflect the Key Cap 1 and Key Cap 2 than the Control Key Cap of conventional design.

Although the invention is shown and described with respect to certain example embodiments, it is obvious that equivalents and modifications will occur to others skilled in the art upon the reading and understanding of the specification. The present invention includes all such equivalents and modifications, and is limited only by the scope of the claims

What is claimed is:

1. A control panel assembly comprising:

a bezel;

a circuit board having an electrical circuit;

a key cap that is disposed between the bezel and the electrical circuit on the circuit board, the key cap undergoing a compression between the bezel and the electrical circuit; and the key cap being buckled due to the compression.

2. The control panel assembly of claim 1 wherein the key cap is in contact with the electric circuit and the key cap is in contact with a protrusion that extends from the bezel.

3. The control panel assembly of claim 1 wherein the key cap is connected to a keypad disposed between the bezel and the circuit board.

4. The control panel assembly of claim 1 wherein:

the key cap has a length that extends along a longitudinal axis between the bezel and the circuit board; and the buckling of the key cap results in a bend along the longitudinal axis, thereby forming an angle of about 160 degrees or less.

5. The control panel assembly of claim 1 wherein the key cap that experiences buckling comprises at least one column having a slenderness ratio, (l/k), according to the formula:

$$\frac{l}{k} \geq \sqrt{\frac{C\pi^2 E}{P_{cr}/A}}$$

wherein l is the length of the column;

wherein k is the radius of gyration;

wherein $P_{cr}/A$ is the critical load;

wherein E is the modulus of elasticity; and wherein C is the end-condition constant and ranges from ¼ to 4.

6. The control panel assembly of claim 5 wherein the at least one column has one end fixed and one end free and C, the end-condition constant, ranges form ¼ to 2.

7. The control panel assembly of claim 5 wherein the at least one column is a helix.

8. The control panel assembly of claim 1 wherein the key cap comprises at least four columns arranged concentrically about an axis.

9. The control panel assembly of claim 8 wherein the at least four columns are connected to one another.

10. The control panel assembly of claim 1 wherein the key cap comprises an elastic material having a modulus of elasticity that is about 500 psi or less.

11. The control panel assembly of claim 1 wherein the key cap comprises a thermoplastic elastomer or thermoset elastomer.

12. The control panel assembly of claim 11 wherein the key cap comprises silicone rubber.

13. The control panel assembly of claim 1 wherein the key cap comprises at least one helical column.

14. The control panel assembly of claim 13 wherein:

the column has a rotational size and a length;

and the pitch of the column is at least as great as ½ the rotational size of the face along the length of the column.

15. The control panel assembly of claim 13 wherein the key cap comprises at least four helical columns arranged concentrically about an axis.

16. The control panel assembly of claim 15 wherein the at least four helical columns are physically connected to each other.

17. The control panel assembly of claim 16 wherein the key cap comprises an elastic material having a modulus of elasticity that is less than about 500 psi.

18. The control panel assembly of claim 17 wherein the key cap comprises a thermoplastic elastomer and a thermoset elastomer.

19. The control panel assembly of claim 18 wherein the key cap comprises silicone rubber.

20. The control panel assembly of claim 1 comprising:

the key cap has a first column and a second column having a first cross-sectional surface area and second cross-sectional surface area;

the first column and the second column are physically connected by a connecting web having a cross-sectional surface area between the first column and the second column that is about 10% or less than the cross-sectional area of at least one of the first column and the second column.

21. A control panel assembly comprising:

a bezel;

an electronic circuit board having electronic circuitry;

a keypad disposed between the bezel and the electronic circuit;

a means for reducing a magnitude of a force exerted on an underside surface of the bezel when the keypad is in physical communication with the bezel and the circuit board.

22. The control panel assembly of claim 21 wherein the means for reducing the force exerted on the underside surface of the bezel is a key cap of the keypad that is capable of buckling when the key cap is in contact with the electronic circuitry.

23. A method for assembling a control panel assembly comprising:

placing a key cap between a bezel and a circuit board;

advancing the key cap into contact with an electrical circuit on the circuit board;

causing the key cap to buckle.

24. The method of claim 23 wherein the key cap comprises at least four columns arranged concentrically about an axis.

25. The method of claim 24 wherein the at least four columns are physically connected to one another.

26. The method of claim 23 wherein the key cap is made of an elastic material having a modulus of elasticity that is less than about 500 psi.

27. The method of claim 26 wherein the key cap comprises silicone rubber.

28. The method of claim 23 wherein the key cap comprises at least one helical column.

29. The method of claim 28 wherein the key cap comprises at least four helical columns arranged concentrically about an axis.

30. The method of claim 29 wherein the at least four helical columns are connected to each other.

31. The method of claim 30 wherein the key cap comprises an elastic material having a modulus of elasticity that is less than about 500 psi.

* * * * *